US008931616B2

(12) United States Patent
Maier et al.

(10) Patent No.: US 8,931,616 B2
(45) Date of Patent: Jan. 13, 2015

(54) SORTING DEVICE

(75) Inventors: Thomas Maier, Dietingen (DE); Julia-Kathrin Vollmer, Geislingen (DE); Carsten Vogt, Sulz a.N. (DE); Bernd Stoll, Rosenfeld (DE)

(73) Assignee: BSAutomatisierung GmbH, Rosenfeld (DE)

( * ) Notice: Subject to any disclaimer, the term of this patent is extended or adjusted under 35 U.S.C. 154(b) by 350 days.

(21) Appl. No.: 13/319,766

(22) PCT Filed: May 5, 2010

(86) PCT No.: PCT/EP2010/002744

§ 371 (c)(1),
(2), (4) Date: Feb. 29, 2012

(87) PCT Pub. No.: WO2010/130360

PCT Pub. Date: Nov. 18, 2010

(65) Prior Publication Data

US 2013/0043103 A1 Feb. 21, 2013

(30) Foreign Application Priority Data

May 13, 2009 (DE) ..... 10 2009 021 073

(51) Int. Cl.
*B07C 5/36* (2006.01)
*A46D 3/08* (2006.01)
*B07C 5/38* (2006.01)

(52) U.S. Cl.
CPC . *B07C 5/36* (2013.01); *A46D 3/082* (2013.01); *A46D 3/085* (2013.01); *B07C 5/38* (2013.01)
USPC ..... 198/347.3; 700/223; 198/347.1; 198/348

(58) Field of Classification Search
CPC ..... B07C 5/36
USPC ..... 198/347.3, 382, 468.2
See application file for complete search history.

(56) References Cited

U.S. PATENT DOCUMENTS

| | | | | |
|---|---|---|---|---|
| 6,878,896 | B2 * | 4/2005 | Braginsky et al. | 209/583 |
| 7,270,226 | B2 * | 9/2007 | Ostrom | 198/358 |
| RE40,797 | E * | 6/2009 | Asgeirsson | 700/213 |
| 7,611,017 | B2 * | 11/2009 | Ottmann | 209/523 |

(Continued)

FOREIGN PATENT DOCUMENTS

| | | |
|---|---|---|
| DE | 25 34 183 A1 | 2/1977 |
| DE | 198 46 411 A1 | 4/2000 |

(Continued)

OTHER PUBLICATIONS

International Search Report mailed on Feb. 7, 2011 for the corresponding International patent application No. PCT/EP2010/002744 (English translation enclosed).

(Continued)

*Primary Examiner* — Gene Crawford
*Assistant Examiner* — Thomas Randazzo
(74) *Attorney, Agent, or Firm* — Posz Law Group, PLC

(57) ABSTRACT

A sorting device having at least one control unit for sorting mixtures of individual elements in sorting units according to at least one characterizing feature of the individual elements and having at least one conveyor belt. The sorting device comprises at least one buffer unit having at least two displaceable storage elements for intermediate storage of individual elements.

18 Claims, 6 Drawing Sheets

(56) References Cited

U.S. PATENT DOCUMENTS

| | | | | |
|---|---|---|---|---|
| 7,863,535 | B2 * | 1/2011 | Reinking | 209/580 |
| 8,158,895 | B2 * | 4/2012 | Grundtvig et al. | 177/145 |
| 8,222,543 | B2 * | 7/2012 | Grundtvig et al. | 177/145 |
| 2004/0159077 | A1 * | 8/2004 | Dombek | 53/444 |
| 2005/0137744 | A1 * | 6/2005 | Winkelmolen et al. | 700/223 |
| 2008/0121569 | A1 | 5/2008 | Ottmann | |

FOREIGN PATENT DOCUMENTS

| | | | |
|---|---|---|---|
| DE | 198 57 053 | A1 | 6/2000 |
| DE | 199 29 985 | A1 | 9/2000 |
| DE | 200 06 059 | U1 | 12/2000 |
| DE | 100 36 297 | A1 | 2/2002 |
| DE | 100 56 032 | A1 | 5/2002 |
| DE | 20 2005 012 865 | U1 | 12/2006 |
| EP | 1 616 635 | A1 | 1/2006 |
| EP | 1 829 621 | A1 | 9/2007 |
| WO | WO 2005/062994 | | 7/2005 |

OTHER PUBLICATIONS

German Search Report mailed on Feb. 19, 2010 for the corresponding German patent application No. 10 2009 021 073.3 (German language report enclosed).

* cited by examiner

SORTING DEVICE

CROSS REFERENCE TO RELATED APPLICATIONS

This application is a U.S. national stage application of PCT/EP2010/002744 filed on May 5, 2010, and claims priority to, and incorporates by reference, German patent application No. 10 2009 021 073.3 filed on May 13, 2009.

It is known, from production technology, for individual elements produced to be collected to form sorting units, so that the sorting units meet predetermined requirements which have to be met by characterizing features of the individual elements, for example colors or sizes.

BACKGROUND

Sorting apparatuses with a control unit and with at least one conveyor belt for sorting mixtures of individual elements in accordance with at least one characterizing feature of the individual elements are known. The sorting apparatus sorts the individual elements in accordance with a procedural instruction which is stored in the control unit and comprises selection criteria in respect of characterizing features of the individual elements.

SUMMARY

The invention is based on a sorting apparatus for sorting mixtures of individual elements with at least one control unit, with some sorting units in which the individual elements can be sorted in accordance with at least one characterizing feature of the individual elements, and with at least one conveyor belt. A "control unit" here is intended to mean, in particular, a device which has an arithmetic unit, a memory unit and an operating program stored therein and is set up, in particular, for picking up electrical characteristics from external sensing means, and for converting these in particular digitally, and for actuating external actuators for controlling and/or regulating purposes. A "sorting unit" here is intended to mean, in particular, a collection of individual elements which, at the end of a sorting operation, meets predetermined requirements to be met by a number of individual elements and predetermined requirements to be met by a number of characterizing features. Collection to form sorting units can serve, for example, for preparing a further flow of material in a production operation or may also constitute collection to form packaging units. A "characterizing feature" here is intended to mean, in particular, a property of an individual element which clearly characterizes the individual element in respect of a predetermined sorting requirement. For example, the characterizing feature may be a color of the individual elements. For a sorting unit, it would then be possible for the predetermined requirements to be, for example, that six individual elements should be collected to form a sorting unit, that each sorting unit should have at least three of five different colors, and that, of each of the at least three colors, no more than three individual elements should be contained in each sorting unit.

It is proposed that the sorting apparatus comprises at least one buffer-storage unit, which has at least two movable storage elements and is intended for the interim storage of individual elements. By means of the buffer-storage unit, it is advantageously possible for individual elements which are not suitable for a sorting unit at a certain point in time of the sorting sequence to be stored on an interim basis until a point in time at which, in accordance with a predetermined sorting instruction, they are suitable for a sorting unit, and therefore the sorting operation can be carried out more quickly. It is advantageously possible for the size of the buffer-storage unit, given by the number of storage elements, to be adapted to the number of different characterizing features of the individual elements.

It is also proposed that the at least one buffer-storage unit has a drive unit, which is provided for displacing each of the at least two storage elements of the buffer-storage unit can be displaced to at least one defined position, as a result of which an individual element can be transported particularly quickly for sorting purposes.

It is further proposed that the sorting apparatus has at least one handling unit with at least two handling elements for handling individual elements. Each of the at least two handling elements is preferably equipped with a gripping means. The handling unit advantageously has at least two drive unit, for example electric or pneumatic motors, for moving the handling elements. It is particularly advantageous for the at least two handling elements to be coupled to one another mechanically and for the handling unit to have just one electric or pneumatic motor for moving one of the at least two handling elements, the at least one indirectly driven handling element therefore being moved as a result of the mechanical coupling. It is particularly advantageous for the handling unit to be equipped with a coupling mechanism, preferably a double-curve mechanism, which uses a single electric or pneumatic motor and guidance of the at least two handling elements, for example along a curved guide track, to convert a rotational movement of the motor into a combined lateral and vertical adjustment.

Particularly advantageously, at least one of the at least two handling elements can be gripped via a separate drive unit irrespective of a lateral and/or vertical adjustment of the at least one of the at least two handling elements.

In an advantageous embodiment, it is further proposed that the sorting apparatus has at least one handling unit, which is provided for transporting the individual elements between the at least one conveyor belt and the at least one buffer-storage unit, as a result of which quick sorting of individual elements in sorting units can take place. An individual element can preferably be transported at a location where the distance between the at least one conveyor belt and the at least one buffer-storage unit is particularly short. The handling unit can advantageously be arranged in a fixed position, within the sorting apparatus, at such a location.

In addition, it is proposed that, at least in one degree of freedom of its movement, the drive unit of the at least one buffer-storage unit has two different movement directions. This allows an individual element to be transported particularly quickly to a defined position. A "degree of freedom of the movement" of the drive unit here is intended to mean, in particular, a translatory movement, a rotational movement and/or a combination of a translatory movement and a rotational movement.

It is also proposed that the sorting apparatus has at least two buffer-storage units, each comprising at least two movable storage elements and provided to pick up individual elements, picked up from the at least one conveyor belt, by the at least one handling unit or to supply individual elements which are to be discharged onto the at least one conveyor belt by the at least one handling unit. The at least two buffer-storage units allow quick sorting of the individual elements in sorting units. It is advantageously possible for the control unit to provide for uniform distribution of individual elements during interim storage in the at least two buffer-storage units, this making it possible to achieve flexible sorting of the individual elements in sorting units.

In an advantageous embodiment, the sorting apparatus comprises at least four buffer-storage units, each having at least two movable storage elements and each being assigned to one another in pairs, and a number of handling units equal to at least half the number of buffer-storage units. "Buffer-storage units assigned in pairs" here is intended to mean, in particular, that an individual element can be transported by means of a handling unit between the two associated buffer-storage units. Such an embodiment can achieve particularly quick and flexible sorting of the individual elements in sorting units. It is advantageously possible for occupancy positions of a sorting unit to be divided up between the at least two handling units, and therefore sorting of a sorting unit by the at least two handling units can be carried out at essentially double the speed.

The sorting apparatus particularly advantageously comprises at least two conveyor belts and at least two buffer-storage units, each having at least two movable storage elements, and a number of handling units at least equal to the number of buffer-storage units, this making it possible to provide a quick solution for sorting individual elements in sorting units. It is preferable for each buffer-storage unit to be assigned at least one handling unit. It is advantageously possible for a first conveyor belt to transport the non-sorted individual elements and for a second conveyor belt to transport the sorting units, as a result of which it is possible to set up a directed flow of material within the sorting apparatus, which can give rise to accelerated sorting.

It is further proposed that at least two of the buffer-storage units are provided to pick up only individual elements which coincide, in each case, in respect of a characterizing feature. This makes it possible to reduce displacement distances of the buffer-storage units which are necessary during sorting and to accelerate a sorting operation.

It is further proposed that the control unit is provided for displacing any storage element of the at least one buffer-storage unit, via the drive unit, over an extremely short distance to a defined position. This allows an individual element to be transported particularly quickly to a defined position and a sorting operation to be accelerated.

In addition, it is proposed that, the control unit is provided for exchanging an individual element of a sorting unit for an individual element with a different characterizing feature which complies with selection criteria stored in the control unit, from a buffer-storage unit for sorting purposes. This makes it possible to achieve quick sorting in accordance with a procedural instruction stored in the control unit. It is advantageously possible for the selection criteria which are stored in the control unit, in relation to the sorting of the individual elements, to be configured freely and modified in a flexible manner.

It is also proposed that the control unit is provided for loading an individual element with a characterizing feature which complies with selection criteria stored in the control unit, into the sorting unit from a buffer-storage unit with the highest occupancy by individual elements with this characterizing feature. "Occupancy" of a buffer-storage unit here is intended to mean, in particular, the number of individual elements with the same characterizing feature which is obtained from a standard calculation which comprises, as its component parts, at least the sum of individual elements fed to the buffer-storage units en route between a defined location of the sorting apparatus and the number of individual elements stored on an interim basis in the relevant buffer-storage unit. This makes it possible for individual elements fed to the sorting apparatus to be sorted particularly uniformly in sorting units, as a result of which stoppage of a flow of material is advantageously avoided and quick sorting of the individual elements can be carried out. The control unit advantageously carries out a check of the occupancy of all the buffer-storage units for the purpose of determining the highest occupancy, at least prior to each control instruction for transporting an individual element.

In an advantageous embodiment, the control unit is provided for exchanging an individual element of a sorting unit for an individual element with a different characterizing feature from a first buffer-storage unit, in order to increase the number of characterizing features of individual elements of a second buffer-storage unit. This makes it possible for individual elements fed to the sorting apparatus to be sorted particularly uniformly in sorting units, as a result of which stoppage of a flow of material is advantageously avoided and quick sorting of the individual elements can be carried out. The control unit advantageously carries out a check of all the buffer-storage units for the purpose of determining the number of characterizing features of each buffer-storage unit, at least prior to each control instruction for transporting an individual element.

Also proposed is a method of operating a sorting apparatus in which, once the at least one feature of an individual element has been detected by a sensing means, the control unit, for the purpose of sorting a sorting unit, carries out virtual filling of an occupancy position within the sorting unit with the individual element. "Virtual filling of an occupancy position within the sorting unit" here is intended to mean, in particular, that the control unit generates control commands for a handling unit for filling the occupancy position of an individual element, these control commands being executed as soon as the occupancy position of the sorting unit has reached the handling unit by means of the at least one conveyor belt.

BRIEF DESCRIPTION OF THE DRAWINGS

Further advantages can be gathered from the following description of the drawing. The drawing illustrates exemplary embodiments of the invention. The description and the claims contain numerous features in combination. A person skilled in the art will expediently also consider the features individually and combine them into further meaningful combinations.

DETAILED DESCRIPTION

FIGS. 1, 2 to 4 and 5 illustrate alternative exemplary embodiments. Essentially equivalent components, features and functions have basically been given the same designations. For the purpose of distinguishing between the exemplary embodiments, however, the letters a, b and c have been added to the designations of the exemplary embodiments, wherein, in respect of equivalent components, features and functions, reference can be made to the description of the exemplary embodiment in FIG. 1.

Figure 1:
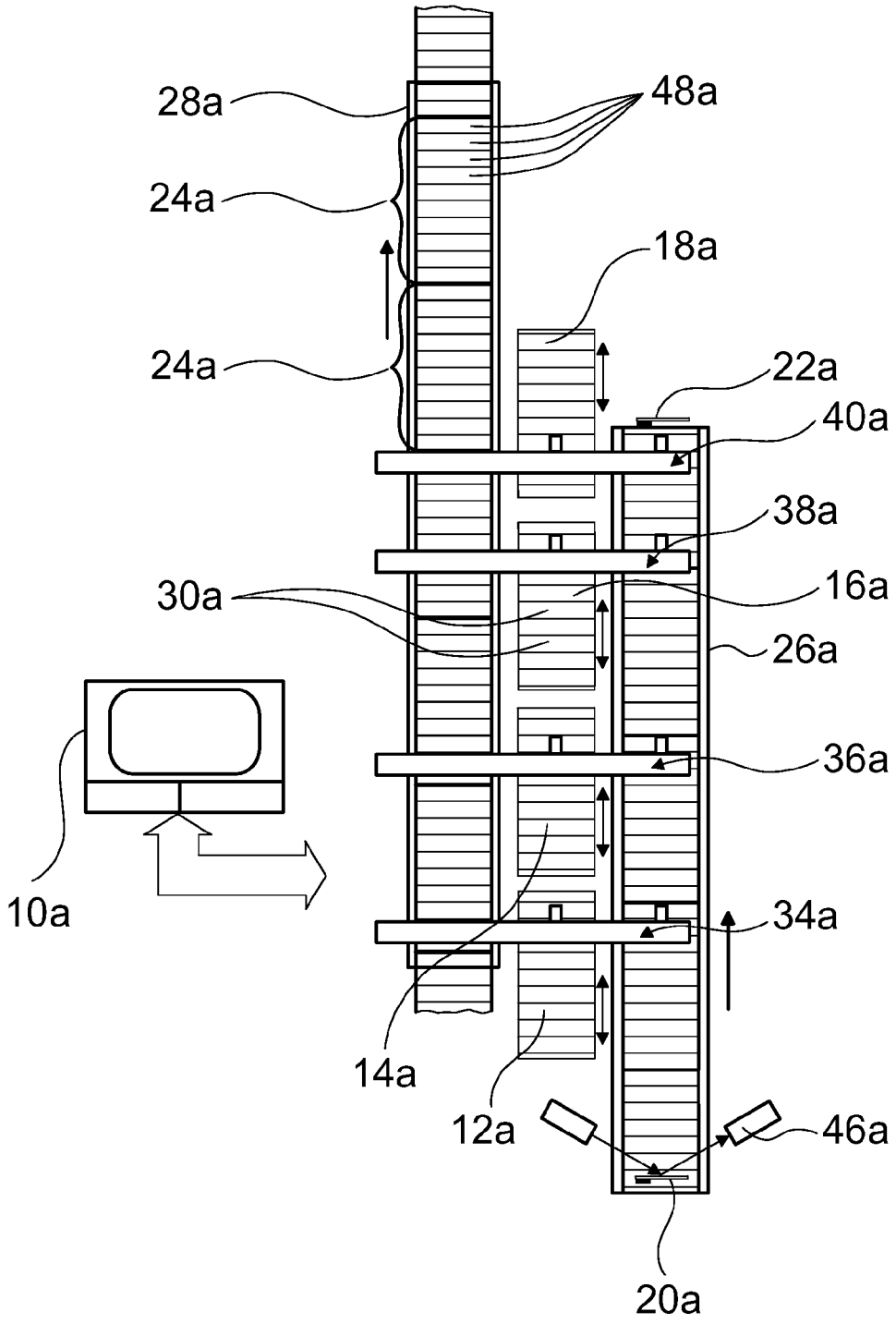
FIG. 1 is a plan view of a sorting apparatus with a control unit, four buffer-storage units, four handling units and two conveyor belts.

FIG. 1 illustrates a plan view of a sorting apparatus for sorting mixtures of individual elements 20*a* with a control unit 10*a*, with some sorting units 24*a* in which the individual elements 20*a* can be sorted in accordance with at least one characterizing feature of the individual elements 20*a*, and with two conveyor belts 26*a*, 28*a*. The individual elements 20*a* are designed as toothbrushes, and the characterizing feature is a handle color, wherein each individual element 20*a* has, as its characterizing feature, one of four different handle colors. The control unit 10 has stored in it a procedural instruction with selection criteria, in accordance with which the sorting units 24*a* constitute packaging units with in each case ten individual elements 20*a*. The selection criteria predetermine that, at the end of a sorting operation, four different handle colors, but no more than four individual elements 20*a* of each handle color, should be present in each sorting unit 24*a*.

The sorting apparatus comprises four buffer-storage units 12*a*, 14*a*, 16*a*, 18*a*, which are provided to pick up only individual elements 20*a* which coincide, in each case, in respect of a characterizing feature, namely the color of the handle. By means of a first conveyor belt 26*a*, the non-sorted individual elements 20*a* can be fed to the sorting apparatus. It is essentially the case that, of each handle color, the same number of individual elements 20*a* is fed to the sorting apparatus. By means of a second conveyor belt 28*a*, the sorting units 24*a* can be removed from the sorting apparatus. By means of the control unit 10*a*, the two conveyor belts 26*a*, 28*a* can be displaced synchronously, once a pre-set period of time has elapsed, via a drive unit (not described in any more detail), by a predetermined distance in the conveying direction (illustrated by arrows in FIG. 1). Common apparatuses and methods for this purpose are known to a person skilled in the art.

Each of the four buffer-storage units 12*a*, 14*a*, 16*a*, 18*a* is designed as a conveyor belt of which the conveying plane, for space-saving reasons, is inclined upward in the conveying direction in relation to the infeeding conveyor belt 26*a* and the outgoing conveyor belt 28*a* and which has ten storage elements 30*a*, which can be moved by means of the conveyor belt and are intended for the interim storage of individual elements 20*a*, of which, for reasons of clarity, only two have been provided with designations in FIG. 1, as being representative of all the storage elements. Each of the four buffer-storage units 12*a*, 14*a*, 16*a*, 18*a* comprises a drive unit (not described in any more detail), by means of which each of the ten storage elements 30*a* of the respective buffer-storage units 12*a*, 14*a*, 16*a*, 18*a* can be displaced to a defined position. This defined position, for each of the four buffer-storage units 12*a*, 14*a*, 16*a*, 18*a*, is located in each case beneath a handling unit 34*a*, 36*a*, 38*a*, 40*a*, the sorting apparatus comprising a number of these handling units equal to the number of buffer-storage units 12*a*, 14*a*, 16*a*, 18*a*. In its degree of freedom of the conveying-belt movement, the drive unit of each of the four buffer-storage units 12*a*, 14*a*, 16*a*, 18*a* has two different movement directions (indicated by double arrows in FIG. 1), to be precise essentially parallel to the conveying direction of the infeeding conveyor belt 26*a* and counter thereto.

Each of the four handling units 34*a*, 36*a*, 38*a*, 40*a* comprises in each case two handling elements 42*a*, 44*a* (FIG. 6) for handling the individual elements 20*a* and is provided in order to transport individual elements 20*a* between the infeeding conveyor belt 20*a* and a buffer-storage unit 12*a*, 14*a*, 16*a*, 18*a* and between a buffer-storage unit 12*a*, 14*a*, 16*a*, 18*a* and the outgoing conveyor belt 28*a*.

A sensing means 46*a* for determining a handle color of an individual element 20*a* guided past the sensing means 46*a* by the infeeding conveyor belt 26*a* is arranged in a fixed position at the start of the conveyor belt 26*a* as seen in the direction of movement. By means of the control unit 10*a*, the color of the individual element 20*a*, and the position thereof on the conveyor belt 26*a*, can be stored in the memory unit of the control unit, and the number of individual elements 20*a* of the same characterizing feature, that is to say of the same handle color, on the infeeding conveyor belt 26*a* between the sensing means 46*a* and a buffer-storage unit 12*a*, 14*a*, 16*a*, 18*a*, which is provided to pick up the individual elements 20*a* of this handle color, can be established, and this number, along with the number of individual elements 20*a* already located in storage elements 30*a* of this buffer-storage unit 12*a*, 14*a*, 16*a*, 18*a*, can be established as a characteristic number of this buffer-storage unit 12*a*, 14*a*, 16*a*, 18*a*.

The control unit 10*a* has stored in it a procedural instruction which comprises selection criteria in respect of the handle colors of the toothbrushes. For the purpose of sorting a sorting unit 24*a*, the control unit 10*a* is also provided, in order to carry out virtual filling of an occupancy position 48*a* within the sorting unit 24*a* with an individual element 20*a*, if this individual element complies with the selection criteria, and an order to determine the occupancy from the characteristic number of the buffer-storage unit 12*a*, 14*a*, 16*a*, 18*a* by subtracting the number of virtual filling operations carried out from the characteristic number of the buffer-storage unit 12*a*, 14*a*, 16*a*, 18*a*.

Furthermore. the control unit 10*a* is provided for loading an individual element 20*a* with a characterizing feature which complies with selection criteria stored in the control unit 10*a*, into a sorting unit 24*a* located on the outgoing conveyor belt 28*a* from a buffer-storage unit 12*a*, 14*a*, 16*a*, 18*a* with the highest occupancy by individual elements 20*a* with this characterizing feature.

At the end of the infeeding conveyor belt 26*a*—as seen in the movement direction—the individual elements 22*a* transported past the handling units 34*a*, 36*a*, 38*a*, 40*a* during sorting fall into a collecting container and are re-fed to the sorting apparatus.

For reasons of clarity, those connections between the control unit 10 and other components of the sorting apparatuses which are necessary for control purposes are illustrated in FIGS. 1 to 5, only by a double arrow symbol, which is intended to indicate that these connections comprise both control lines and data lines. Common embodiments of connections which serve these purposes are known to a person skilled in the art.

Figure 2:
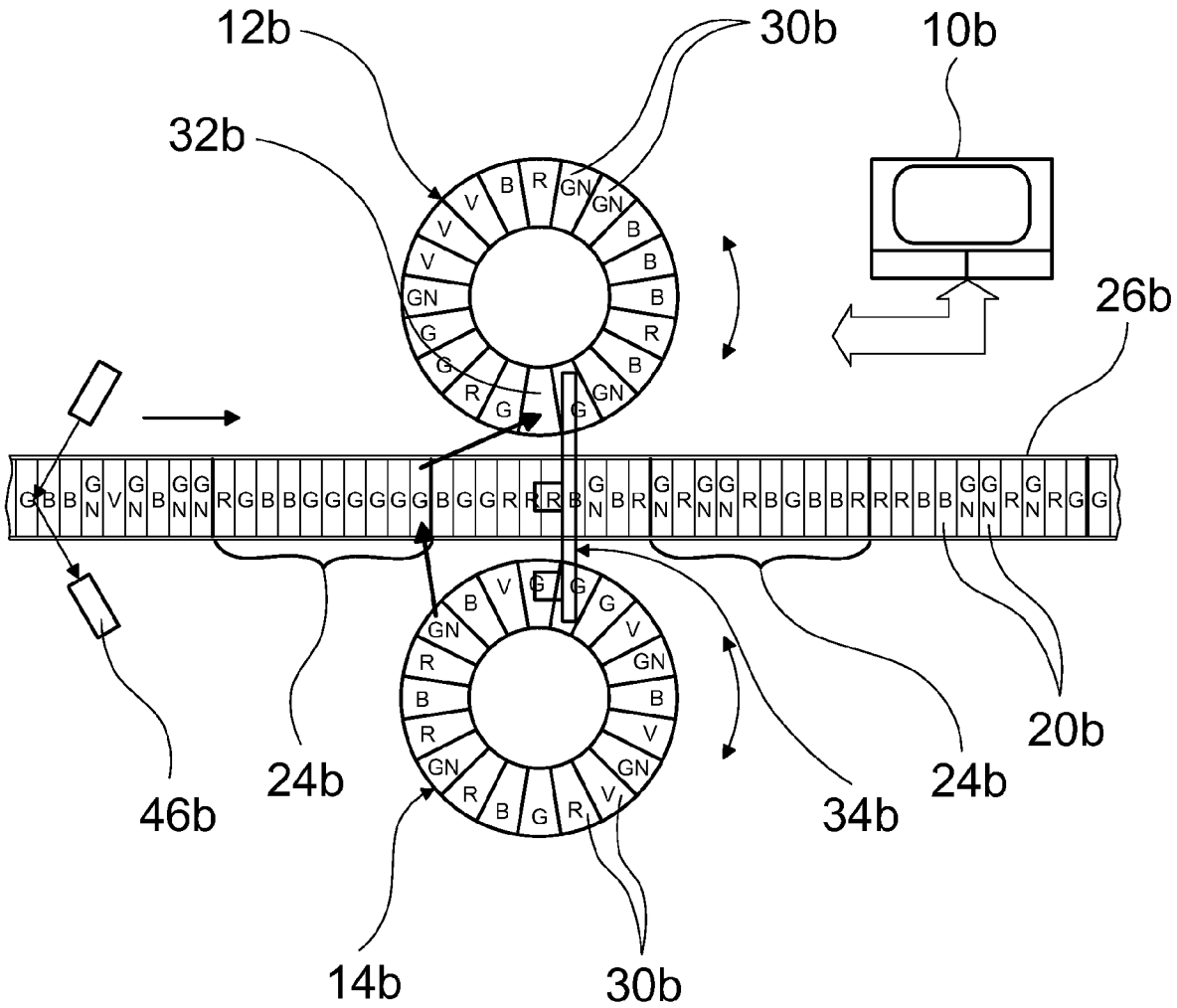
FIG. 2 is a plan view of a further sorting apparatus with a control unit, two buffer-storage units, a handling unit and a conveyor belt.

FIG. 2 illustrates a further sorting apparatus with a control unit 10*b*, for sorting mixtures of individual elements 20*b* in sorting units 24*b* in accordance with a characterizing feature of the individual elements 20*b*, and with a conveyor belt 26*b*. The individual elements 20*b* are defined, once again, as toothbrushes with in this case five different handle colors as the characterizing feature. The individual elements 20*b* are indicated in FIG. 2 by capitalized initial letters for their handle colors: G=yellow, R=red, GN=green, B=blue, V=violet. At the beginning, the conveyor belt 26*b*, which is moved by the control unit 10*b* from left to right by activation of a drive unit (not described in any more detail), is filled with the non-sorted individual elements 20*b*, and therefore the sorting units 24*b* are filled with in each case ten individual elements 20*b* in any order.

The sorting apparatus has two buffer-storage units 12*b*, 14*b*, which are arranged opposite one another on either side of the conveyor belt 26*b*, and a fixed-position handling unit 34*b*, which is configured in the same manner as the handling unit 34*a* illustrated in FIG. 1.

Figure 3:
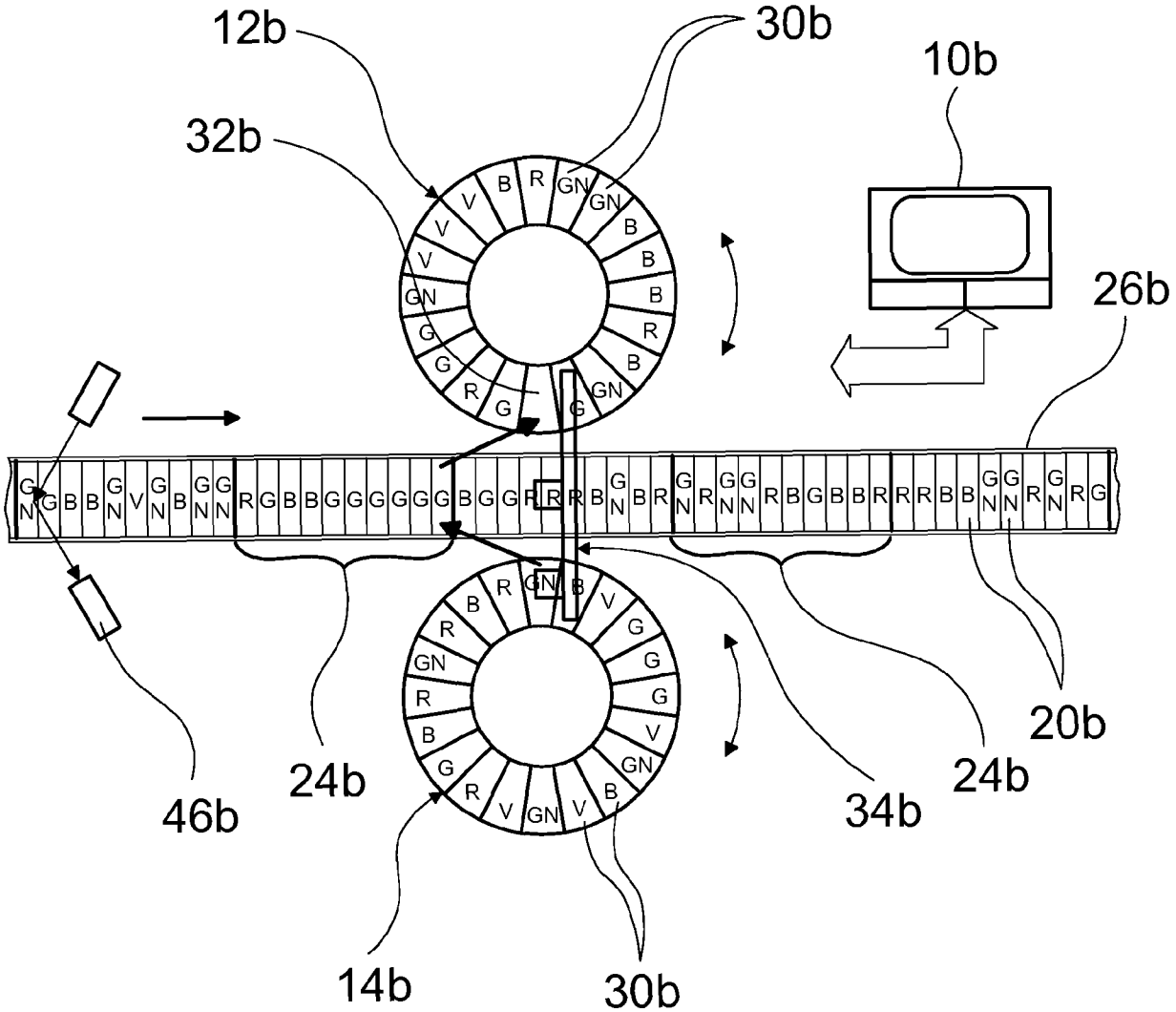
FIG. 3 is the sorting apparatus according to FIG. 2 in a further sorting situation.
Figure 5:
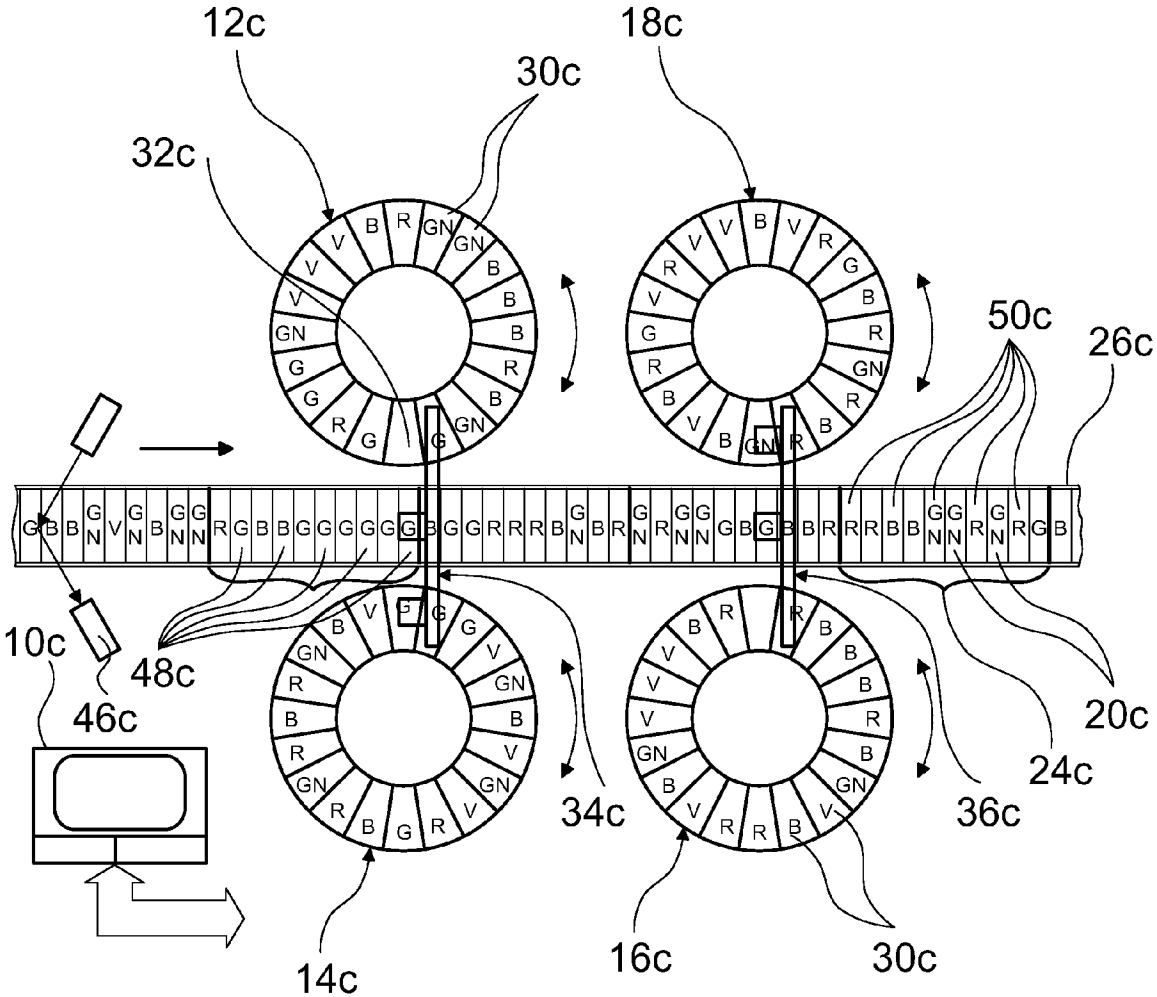
FIG. 5 is a plan view of the sorting apparatus according to FIG. 2 with two additional buffer-storage units and an additional handling unit.

The two buffer units 12*b*, 14*b* each comprise twenty storage elements 30*b*, which can be moved by a turntable, and they are each equipped with a dedicated turntable drive unit, which, in its rotational degree of freedom, has two different movements, that is to say in the clockwise direction and in the counterclockwise direction (indicated by double arrows in FIGS. 2, 3, and 5). The two buffer-storage units 12*b*, 14*b* are provided to pick up individual elements 20*b* picked up from the conveyor belt 26*b* by the handling unit 34*b* or to supply individual elements 20*b* which are to be discharged onto the conveyor belt 26*b* by the handling unit 34*b*.

For startup of the sorting apparatus, the first individual elements 20*b* from the sorting units 24*b* are distributed alternately, by means of the handling unit 34*b*, between the storage elements 30*b* of the buffer-storage units 12*b*, 14*b* until all the storage elements 30*b* of the one buffer-storage unit 14*b* and all the storage elements 30*b*, with the exception of one storage element 32*b*, of the other buffer-storage unit 12*b* have been filled with individual elements 20*b*.

The control unit 10*b* is provided for displacing any storage element 30*b*, 32*b* of each of the two buffer-storage units 12*b*, 14*b*, via its drive unit, over an extremely short distance to a defined position, beneath the handling unit 34*b*. In addition, the control unit 10*b* is provided for exchanging an individual element 20*b* of a sorting unit 24*b* for an individual element 20*b* with a different characterizing feature, which complies with selection criteria stored in the control unit 10*b*, from a buffer-storage unit 12*b*, 14*b*, for sorting purposes.

Figure 4:
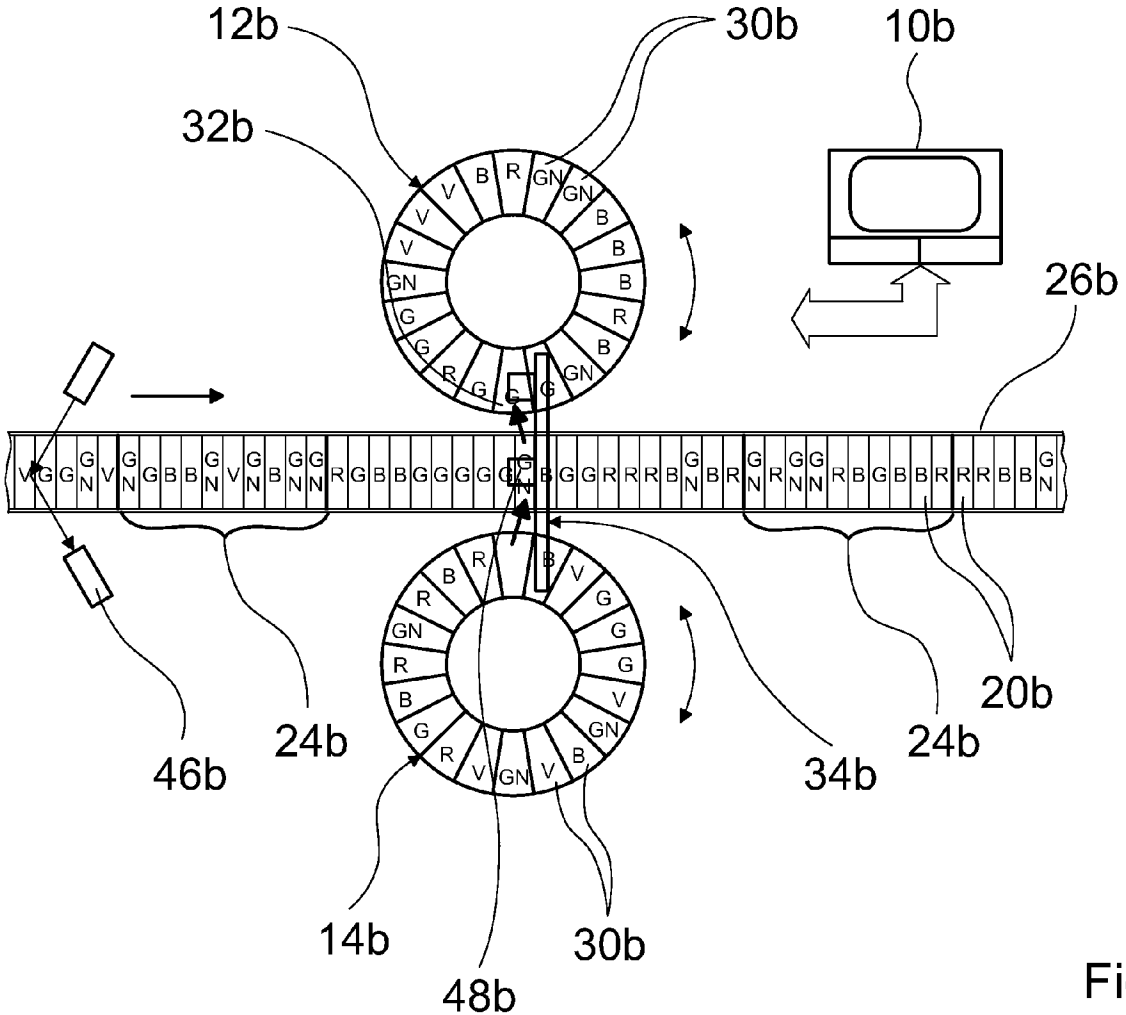
FIG. 4 is the sorting apparatus according to FIG. 2 in a further sorting situation.

In the situation which is illustrated in FIG. 2, one sorting unit 24*b*, to be precise the second from the left, infringes the selection criteria stored in the control unit 10*b*, because it contains too many toothbrushes with a yellow handle. On account of a stored method sequence, the control unit 10*b* has decided to exchange the toothbrush with a yellow handle closest to the handling unit 34*b* for a toothbrush with a green handle from the lower buffer-storage unit 14*b*. For preparatory purposes, by means of the control unit 10*b*, the free storage element 32*b* of the buffer-storage unit 12*b*, which is illustrated at the top of FIG. 2, and that storage element 30*b* of the buffer-storage unit 14*b*, illustrated at the bottom of FIG. 2, which is closest to the handling unit 34*b* and has been filled with a toothbrush with a green handle can be displaced to the defined position beneath the handling unit 34*b* (FIG. 3). As soon as the conveyor belt 26*b* has been displaced to the extent where the toothbrush with a yellow handle closest to the handling unit 34*b* has reached the position of the handling unit 34*b*, a first handling element 44*b* of the handling unit 34*b* removes the toothbrush with the green handle from the buffer-storage unit 14*b* and a second handling element 42*b* of the handling unit 34*b* removes the toothbrush with the yellow handle from the sorting unit 24*b*. During the subsequent movement of the handling unit 34*b*, which will be explained hereinbelow, the toothbrush with the yellow handle is transported into the free storage element 32*b* of the buffer-storage unit 12*b* and the toothbrush with the green handle is transported into a freed occupancy position 48*b* of the sorting unit 24*b* (FIG. 4).

The sorting apparatus according to FIG. 2 has been extended to form a sorting apparatus according to FIG. 5 by the addition of a further pair of buffer-storage units 16*c*, 18*c* of the same design, and a further handling unit 36*c* of the same design, at a different location of a conveyor belt 26*c*. The four buffer-storage units 12*c*, 14*c*, 16*c*, 18*c* each have twenty movable storage elements 30*c* and are each assigned to one another in pairs and are arranged opposite one another on either side of the conveyor belt 26*c*. A handling unit 34*c*, 36*c* is located in each case between the pairs of buffer units 12*c* and 14*c* and also 16*c* and 18*c*, respectively, and therefore the number of handling units 34*c*, 36*c* in this sorting apparatus corresponds precisely to the number of pairs of buffer-storage units 12*c*, 14*c*, 16*c*, 18*c*. A control unit 10*c* is provided in order to control the handling units 34*c*, 36*c* such that the foremost handling unit 34*c*, as seen in a movement direction of the conveyor belt 26*c*, transports only individual elements 20*c* from and/or to odd-numbered occupancy positions 48*c* of a sorting unit 24*c* and the downstream handling unit 36*c*, as seen in a movement direction of the conveyor belt 26*c*, transports only the individual elements 20*c* from and/or to even-numbered occupancy positions 50*c* of the sorting unit 24*c*. This makes it possible essentially to double the conveying speed of the conveyor belt 26*c* in comparison with the sorting apparatus according to FIG. 2.

The control unit 10*c* also is provided for exchanging an individual element 20*c* of a sorting 24*c* unit for an individual element 20*c* with a different characterizing feature from a first buffer-storage unit 18*c*, in order to increase the number of characterizing features of individual elements 20*c* of a second buffer-storage unit 16*c*. Since, in the exemplary embodiment of FIG. 5, the buffer-storage unit 16*c* in the sorting situation illustrated does not have any toothbrushes with a yellow handle in its storage elements 30*c*, the control unit 10*c* is provided in order to remove a toothbrush with a yellow handle from one of the closest sorting units 24*c* by means of the handling unit 36*c*, if, as illustrated, a further toothbrush with a yellow handle is also contained therein, and to displace this toothbrush into the buffer-storage unit 16*c*, in order to increase the number of different colors of individual elements 20*c* of the buffer-storage unit 16*c*, even if none of the selection criteria stored in the control unit 10*c* is infringed in the relevant sorting unit 24*c*. The toothbrush with a yellow handle removed from the sorting unit 24*c* is replaced, by means of the handling unit 36*c*, by a toothbrush with a green handle color, and therefore the selection criteria stored in the control unit 10*c* are still maintained.

Figure 6:
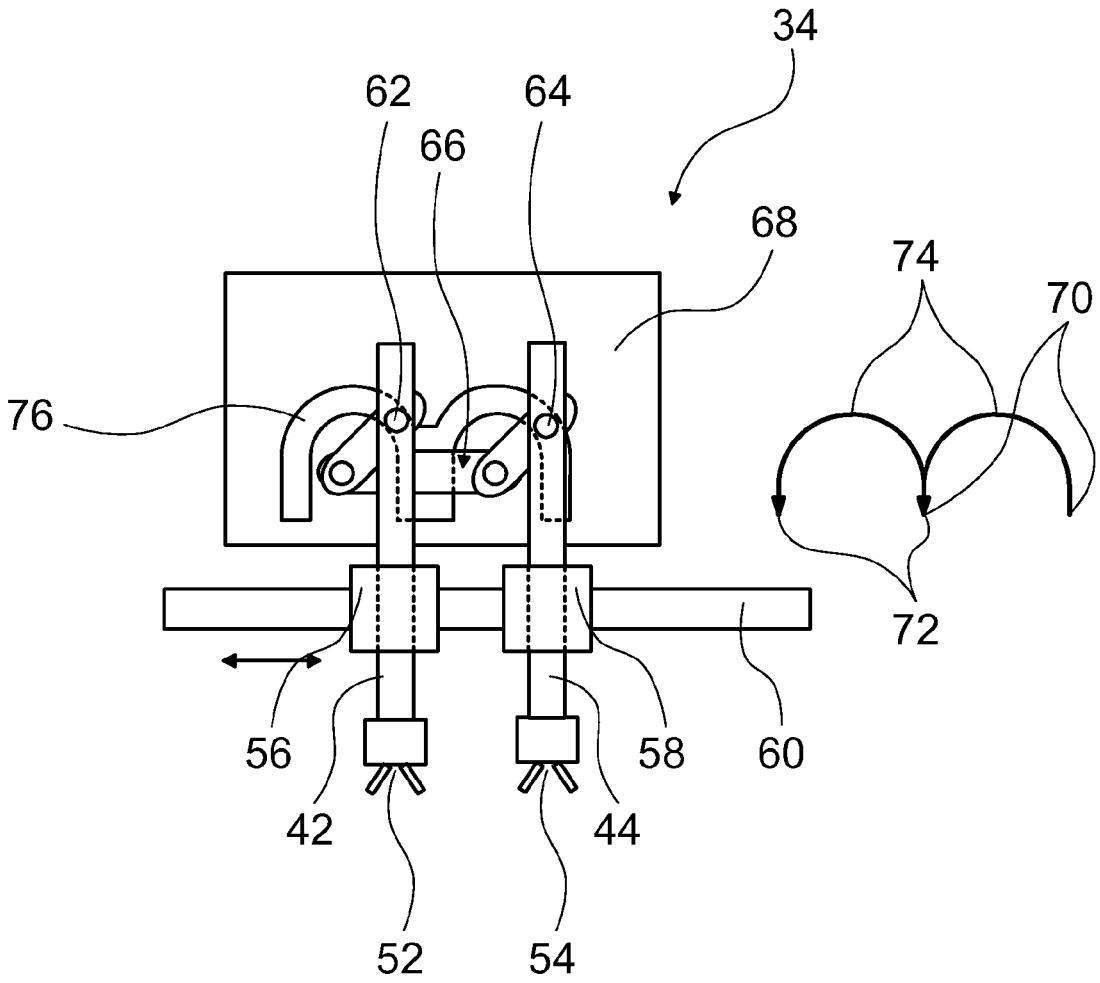
FIG. 6 is a front view of a handling unit with two handling elements and a coupling mechanism.

FIG. 6 illustrates, in detail form, a handling unit from the exemplary embodiments described in FIGS. 1, 2 to 4 and 5. The handling unit 34 comprises two handling elements 42, 44, each having a gripping means 52, 54 at a lower end. The handling elements 42, 44 are guided for sliding action in each case in a lower third by means of a sliding-guidance element 56, 58, which is mounted in a movable manner on a horizontal rail 60. Each handling element 42, 44 is equipped, in its upper third, with a guide pin 62, 64, on which it is articulated at one end of a coupling unit 66 comprising three articulation parts. The guide pins 62, 64 of the handling elements 42, 44 are each arranged in an arcuate slot 76 of a guide means 68, wherein side peripheries of the slot 76 provide lateral guidance for the guide pins 62, 64. One of the three articulation parts of the coupling unit 66, it being possible for these parts to be moved in a single plane, has its end which is directed away from the coupling unit 66 articulated on a drive (not illustrated specifically), which is provided to displace this articulation part. Common methods for this purpose are known to a person skilled in the art. The coupling of the handling elements 42, 44 to the coupling unit 66 and the guidance of the guide pins 62, 64 within the slot 76 of the guide means 68 make it possible to achieve movement of the two handling elements 42, 44 in which the two handling elements 42, 44 in the first instance reach a first low position 70 and then following the course of an arcuate movement corresponding to the slot 76 of the guide means 68, once a high position 74 has been reached, are displaced into a second low position 72, which is offset laterally in relation to the first low position 70, wherein the two handling elements maintain vertical positioning on account of the two sliding-guidance elements 56, 58.

In the low positions 70, 72 of the two handling elements 42, 44, it is possible, independently of one another, for the gripping means 52, 54 of the handling elements 42, 44 to be caused, by the control unit 10, to grip an individual element 20, or set an individual element down, in each case.

In the first low position 70 of the two handling elements 42, 44, the gripping means 52, 54 of the latter, in the case of the sorting apparatus according to FIG. 1, are located in each case above the infeeding conveyor belt 26*a* and above a buffer-storage unit 12*a*, 14*a*, 16*a*, 18*a* and, in the second low position 72, they are located in each case above the relevant buffer-storage unit 12*a*, 14*a*, 16*a*, 18*a* and above the outgoing conveyor belt 28*a*.

In the case of the sorting apparatus according to FIG. 2, the gripping means 52, 54 of the two handling elements 42, 44 are located, in the first low position 70, in each case above a first buffer-storage unit 14*b* and above the conveyor belt 26*b* and, in the second low position 72, in each case above the conveyor belt 26*b* and above a second buffer-storage unit 12*b*. The same applies to the sorting apparatus according to FIG. 5.

The invention claimed is:

1. A sorting apparatus for sorting mixtures of individual elements, comprising:

at least one control unit;

sorting units in which the individual elements can be sorted in accordance with at least one characterizing feature of the individual elements;

at least one conveyor belt;

at least one buffer-storage unit, which has at least two movable storage elements and which is intended for the interim storage of individual elements, and at least one handling unit, which comprises at least two handling elements for handling the individual elements, wherein the at least one control unit controls, for sorting purposes, exchanging an individual element of a sorting unit for an individual element, with a different characterizing feature which complies with selection criteria stored in the at least one control unit, from the at least one buffer-storage unit, and wherein the at least two handling elements of the at least one handling unit are coupled to one another mechanically.

2. The sorting apparatus at least as claimed in claim 1, wherein the at least one handling unit transports the individual elements between the at least one conveyor belt and the at least one buffer-storage unit.

3. The sorting apparatus at least as claimed in claim 1, further comprising:

at least four buffer-storage units, wherein each of the at least four buffer-storage units has at least two movable storage elements, and is paired off with another one, and wherein a number of handling units equals at least half the number of buffer-storage units.

4. The sorting apparatus at least as claimed in claim 1, further comprising:

at least two conveyor belts; and at least two buffer-storage units, wherein each of the at least two buffer-storage units has at least two movable storage elements, and a number of handling units is at least equal to the number of buffer-storage units.

5. The sorting apparatus at least as claimed in claim 1, wherein the at least one control unit controls loading an individual element with a characterizing feature complying with selection criteria stored in the at least one control unit into the sorting unit from a buffer storage unit with the highest occupancy by individual elements with this characterizing feature.

6. The sorting apparatus at least as claimed in claim 1, wherein the at least one control unit controls exchanging an individual element of a sorting unit for an individual element with a different characterizing feature from a first buffer-storage unit, in order to increase the number of characterizing features of individual elements of a second buffer-storage unit.

7. The sorting apparatus at least as claimed in claim 1, further comprising:

at least two buffer-storage units, wherein each of the at least two buffer-storage units comprises at least two movable storage elements, and picks up individual elements picked up from the at least one conveyor belt by the at least one handling unit or to supply individual elements which are to be discharged onto the at least one conveyor belt by the at least one handling unit.

8. The sorting apparatus at least as claimed in claim 7, wherein the at least two buffer-storage units pick up only individual elements which coincide, in each case, in respect of a characterizing feature.

9. The sorting apparatus as claimed in claim 1, wherein the at least one buffer-storage unit has a drive unit which displaces each of the at least two storage elements of the buffer-storage unit to at least one defined position.

10. The sorting apparatus at least as claimed in claim 9, wherein at least in one degree of freedom of its movement, the drive unit of the at least one buffer-storage unit has two different directions of movement.

11. The sorting apparatus at least as claimed in claim 10, wherein the at least one control unit controls displacing any storage element of the at least one buffer-storage unit, via the drive unit, over minimum possible distance to a defined position.

12. The sorting apparatus at least as claimed in claim 1, wherein the at least one handling unit has just one electric or pneumatic motor for moving one of the at least two handling elements, such that the at least one indirectly driven handling element therefore is moved as a result of the mechanical coupling.

13. The sorting apparatus at least as claimed in claim 12, wherein the at least one handling unit is equipped with a double-curve mechanism, which uses a single electric or pneumatic motor and guidance of the at least two handling elements to convert a rotational movement of the motor into a combined lateral and vertical adjustment.

14. The sorting apparatus at least as claimed in claim 12, wherein the at least two handling elements of the at least one handling unit have gripping means which can be caused by the control unit, to grip an individual element, or set an individual element down, in each case, independently of one another.

15. A method of operating a sorting apparatus for sorting mixtures of individual elements, the apparatus comprising:

at least one control unit;

sorting units in which the individual elements can be sorted in accordance with at least one characteristic feature of the individual elements;

at least one conveyor belt; and at least two buffer-storage units, each buffer-storage unit having at least two movable storage elements, each movable storage element being intended for the interim storage of an individual element, the two buffer-storage units being arranged opposite one another on either side of the conveyor belt, the method comprising:

at least one step for startup of the sorting apparatus in which the first individual elements from the sorting units are distributed alternatively, by means of the handling unit, between the storage elements of the buffer-storage units, and at least one step in which for sorting purposes, an individual element of a sorting unit is exchanged for an individual element, with a different characterizing feature which complies with selection criteria stored in the at least one control unit, from a buffer-storage unit.

16. A method of operating a sorting apparatus as claimed in claim 15, further comprising:

at least one step in which for sorting purposes, an individual element with a characterizing feature which is allowed by selection criteria stored in the at least one control unit is loaded into a sorting unit from a buffer-storage unit with the highest occupancy by individual elements with this characterizing feature.

17. A method of operating a sorting apparatus as claimed in claim 15, further comprising:

at least one step in which the at least one control unit, the at least one feature of an individual element having been detected by a sensing element, for the purpose of sorting a sorting unit, carries out virtual filling of an occupancy position within the sorting unit with the individual element.

18. A method of operating a sorting apparatus as claimed in claim 15, further comprising at least one step in which for sorting purposes, an individual element of a sorting unit is exchanged for an individual element with a different characterizing feature from a first buffer-storage unit, in order to increase the number of characterizing features of individual elements of a second buffer-storage unit.

* * * * *